US006058869A

United States Patent [19]

Thon

[11] Patent Number: 6,058,869

[45] Date of Patent: May 9, 2000

[54] FLOATING PONTOON STRUCTURE WITH ADJUSTABLE DRAFT

[76] Inventor: Ralph C. Thon, 118 Skylark, Bridge City, Tex. 77611

[21] Appl. No.: 09/199,098

[22] Filed: Nov. 24, 1998

Related U.S. Application Data

[60] Provisional application No. 60/066,835, Nov. 25, 1997.

[51] Int. Cl.[7] ..... B63B 39/03

[52] U.S. Cl. ..... 114/125; 114/263

[58] Field of Search ..... 114/61, 123, 292, 114/283, 121, 125, 44, 45, 264, 265, 263

[56] References Cited

U.S. PATENT DOCUMENTS

| | | | |
|---|---|---|---|
| 1,412,852 | 4/1922 | Engstrand | 114/45 |
| 3,024,753 | 3/1962 | Benson, Jr. | 114/263 |
| 4,479,450 | 10/1984 | Lundberg | 114/125 |
| 4,615,289 | 10/1986 | Bloxham | 114/45 |

*Primary Examiner*—Stephen Avila
*Attorney, Agent, or Firm*—Ronald B. Sefrna

[57] ABSTRACT

A floating pontoon structure with adjustable draft includes a lower section with an enclosed hollow hull and a lower deck connected thereto, a supporting framework extending upwardly from the lower deck, an upper deck connected to the supporting framework in parallel spaced apart relation to the lower deck, a ballast tank disposed in the hollow hull of the lower section, a valved passageway between the ballast tank and the exterior of the hull for filling and emptying the ballast tank, and one or more flotation tanks disposed between the lower deck and the upper deck to provide positive buoyancy when the ballast tank is filled. A method of connecting a plurality of pontoon structures to form a larger composite structure and a method of adjusting the draft of the larger composite structure are also provided.

16 Claims, 8 Drawing Sheets

FLOATING PONTOON STRUCTURE WITH ADJUSTABLE DRAFT

RELATED APPLICATION DATA

This application claims the benefits of Provisional Application Ser. No. 60/066,835, filed Nov. 25, 1997, titled "Floating Pontoon Structure With Adjustable Draft".

FIELD OF THE INVENTION

The present invention generally relates to floating construction component apparatus, and in its preferred embodiments more specifically relates to floating construction component structures such as barges, floats, pontoons, and similar floating components in which the draft of the floating structure is adjustable.

BACKGROUND OF THE INVENTION

The use of floating barge sections or pontoons, which are connected together in side by side and/or end to end relationship to form larger floating structures, is well known in the prior art. Structures formed from such modular components include transport barges, work platforms, cargo platforms, floating bridges, piers, and docks. The individual modules or pontoons used to form such structures typically comprise a hollow hull that is fully enclosed with a bottom, side walls, and a flat, typically rectangular deck that forms the top closure of the hull and serves as a storage or work area. In at least most designs the bottom of the hull is flat or predominantly flat, and the side walls extend vertically between the deck and the hull bottom in generally perpendicular relation thereto. The modules are typically joined together by releasable mechanical connectors that firmly connect adjacent modules.

The modular components are typically transported individually to the location where the combined structure is to be assembled and are then aligned and connected while the components are floating on the body of water in which the structure is located. With the conventional pontoon components known in the prior art the connection process, which requires precise alignment between floating components, can only be performed when the body of water on which the components are floating is relatively calm. When the water is turbulent the connection process becomes much more difficult, or impossible, to perform.

Inclement weather and turbulent water conditions can also create problems after components have been connected to form a larger structure. The floating pontoons or barge sections of the prior art, with their continuous side walls, present a large surface area to wave impingement and the lateral forces resulting from wave impact can be significant. In addition, the barge sections of the prior art are buoyant and float on the surface of the water with relatively low draft, so that they tend to follow the undulating movement of the surface of the water as it rises and falls with wave action. As a result, the vertical and lateral forces imposed on the connections between components can become high and threaten the integrity of the connected structure. Further, the pitching and rolling movement of the structure during turbulent water conditions can endanger cargo stored on the deck of the structure and make working on the deck very hazardous.

In a partial response to these problems, efforts have been made to develop apparatus for connecting pontoons or barge sections that will withstand the forces and stresses imposed during inclement weather and turbulent water conditions.

Such efforts have been generally successful in providing for strong connections between components, but maintaining secure connections between sections does not address and cannot alleviate the other problems associated with the prior art designs.

SUMMARY OF THE INVENTION

The pontoon apparatus of the present invention significantly reduces the problems associated with the floating component designs known in the prior art, both during connection and after connection of the components. The present invention provides a pontoon apparatus with a ballast tank which may be selectively filled with and emptied of water to adjust the draft, or depth to which the pontoon structure extends below the surface of the water, and a method of adjusting the draft of the pontoon apparatus. When the ballast tank is empty of water the pontoon floats relatively high in the water, with maximum buoyancy and load supporting capacity. When the ballast tank is filled with water the pontoon floats relatively low in the water, increasing its stability and resistance to wave induced motion. The tank is filled through a conduit extending between the tank and an opening in the hull of the pontoon below the waterline. A valve is provided in the conduit to control flow, and the tank is vented to prevent excessive air pressure from building up as water fills the tank. In the preferred embodiments the ballast tank is emptied by introducing pressurized air into the tank to force the water from the tank through the conduit, although the tank may also be emptied by pumping water from the tank.

In contrast to the fully enclosed pontoon designs known in the prior art, the pontoon apparatus of the invention is constructed with an enclosed lower section containing the ballast tank, and an upper, open framework supporting the deck of the pontoon above the enclosed lower section. When the ballast tank is filled the enclosed lower section is completely or substantially below the water line, with the deck and supporting framework above the water line, so that the open framework of the upper section allows waves to pass through the structure with minimal resistance.

In the preferred embodiments the pontoon of the invention includes at least one flotation tank disposed between the lower section and the deck, to assure that the pontoon will remain buoyant when the ballast tank is completely filled and the deck is heavily loaded. The flotation tank or tanks may be used as a source of pressurized air for emptying the ballast tank.

DETAILED DESCRIPTION OF THE PREFERRED EMBODIMENT

Figure 2:
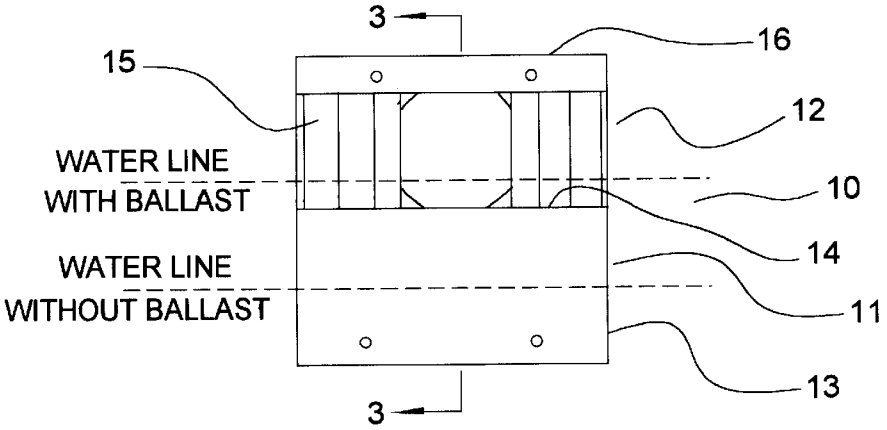
FIG. 2 is an end elevation view of the preferred embodiment of the pontoon structure of the invention.
Figure 1:
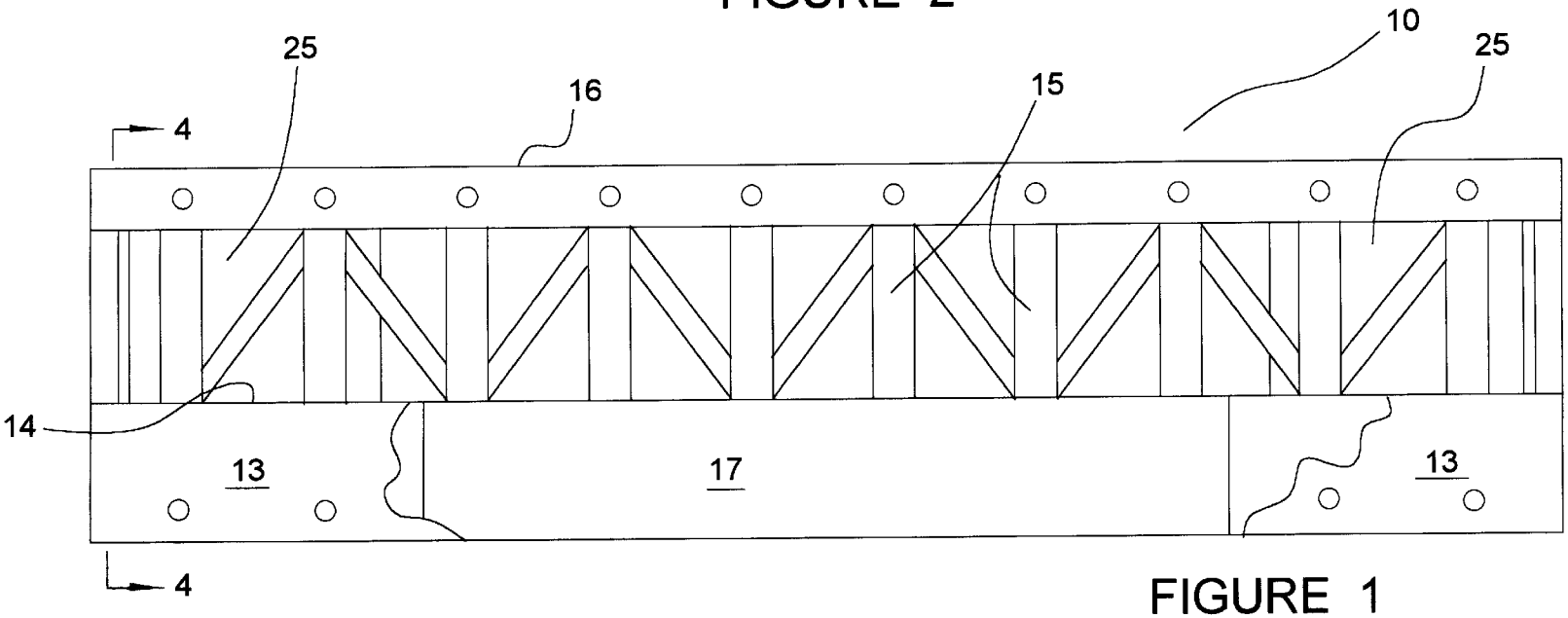
FIG. 1 is a partially cut-away side elevation view of the preferred embodiment of the pontoon structure of the invention.

Referring now to the drawing figures, FIG. 1 and FIG. 2 show a side elevation view (partially cut-away to illustrate internal structure) and an end elevation view, respectively, of the pontoon structure of the invention. In contrast to pontoon designs of the prior art, the pontoon structure of the invention, generally designated by reference numeral 10, is divided into a lower section 11 and an upper section 12. The lower section includes hull 13 and deck 14, connected to enclose a hollow interior, and is provided with an appropriate structural framework. The structural framework utilized in the construction of hull 13 and deck 14 may be of any convenient conventional design, so long as provision is made for the inclusion of a ballast tank and associated piping and control means.

The upper section of the pontoon of the invention includes a structural framework generally comprising frame members 15 extending upwardly from the lower section, and a cargo deck 16, supported on frame members 15, parallel to and overlying deck 14 of the lower section. The arrangement of frame members 15 shown in the drawings is illustrative, and it will be understood that other arrangements consistent with the purposes of the invention may be used. The space between deck 14 and deck 16 is not enclosed by a hull, and is generally open to allow the passage of water through the space between the decks.

The lower section 11 of the pontoon structure of the invention includes a ballast tank 17, symmetrically disposed in and occupying the majority of the volume of the interior of the lower section. Ballast tank 17 is adapted to be selectively filled with and emptied of water, so as to decrease and increase, respectively, the buoyancy of the pontoon, causing it to sink or rise in the water in which the pontoon structure is floating, thereby adjusting the draft of the pontoon structure. Approximate water line positions relative to the pontoon with the ballast tank filled (i.e., with ballast) and empty (i.e., without ballast) are indicated in FIG. 2. It will be understood that the minimum draft of the pontoon, i.e., with the ballast tank empty, and the maximum draft of the pontoon, i.e., with the ballast tank completely filled, will be affected by the weight of cargo placed on upper deck 16. However, since the degree to which the ballast tank is filled may be controlled, the draft of the pontoon is readily adjustable between minimum and maximum values. Ballast tank 17 may be provided with internal baffles, if desired, to reduce sloshing of water contained in the ballast tank without interfering with the filling and emptying of the ballast tank.

Figure 3:
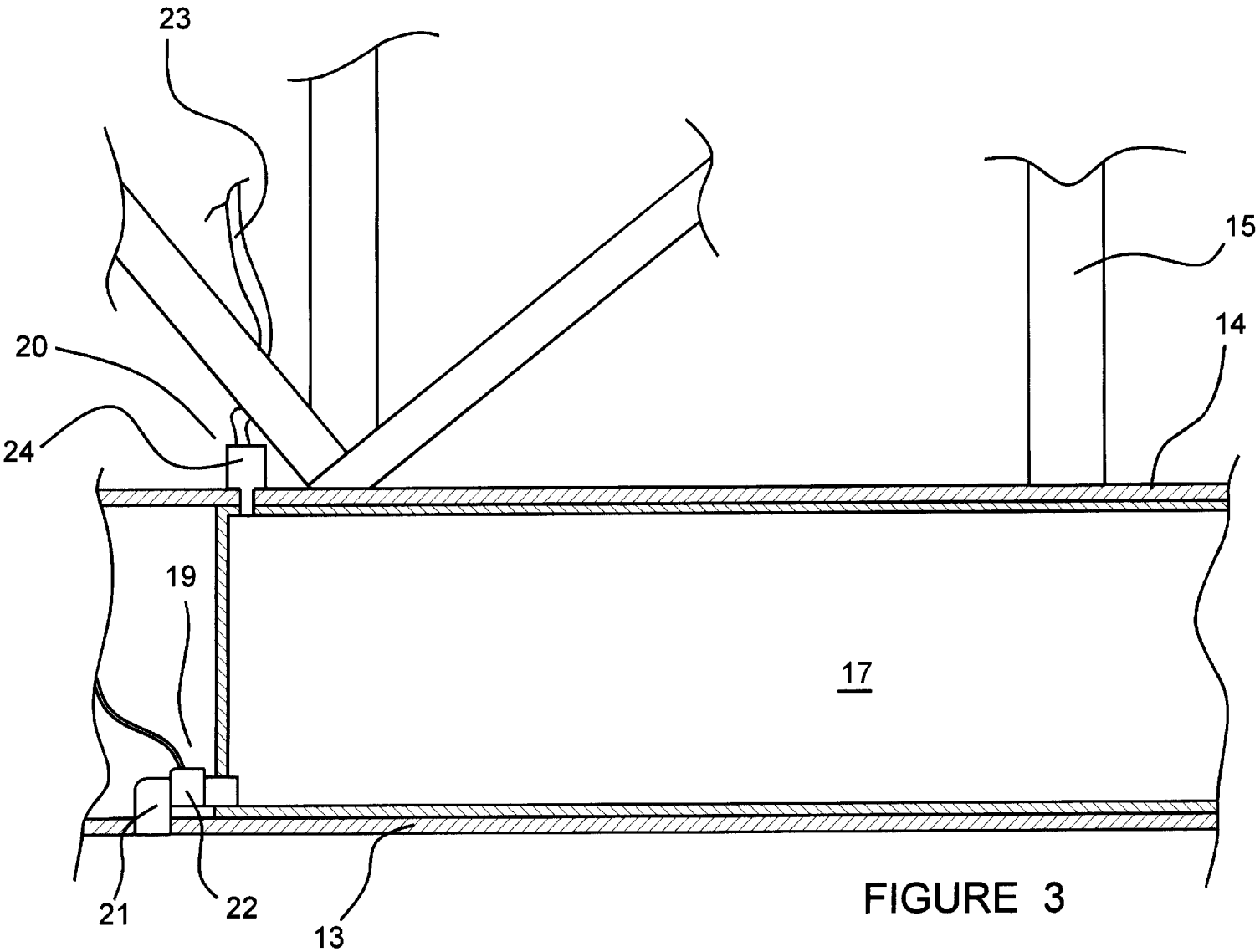
FIG. 3 is a partial, sectioned side elevation view of the preferred embodiment of the pontoon structure of the invention, along line 3—3 of FIG. 2.
Figure 4:
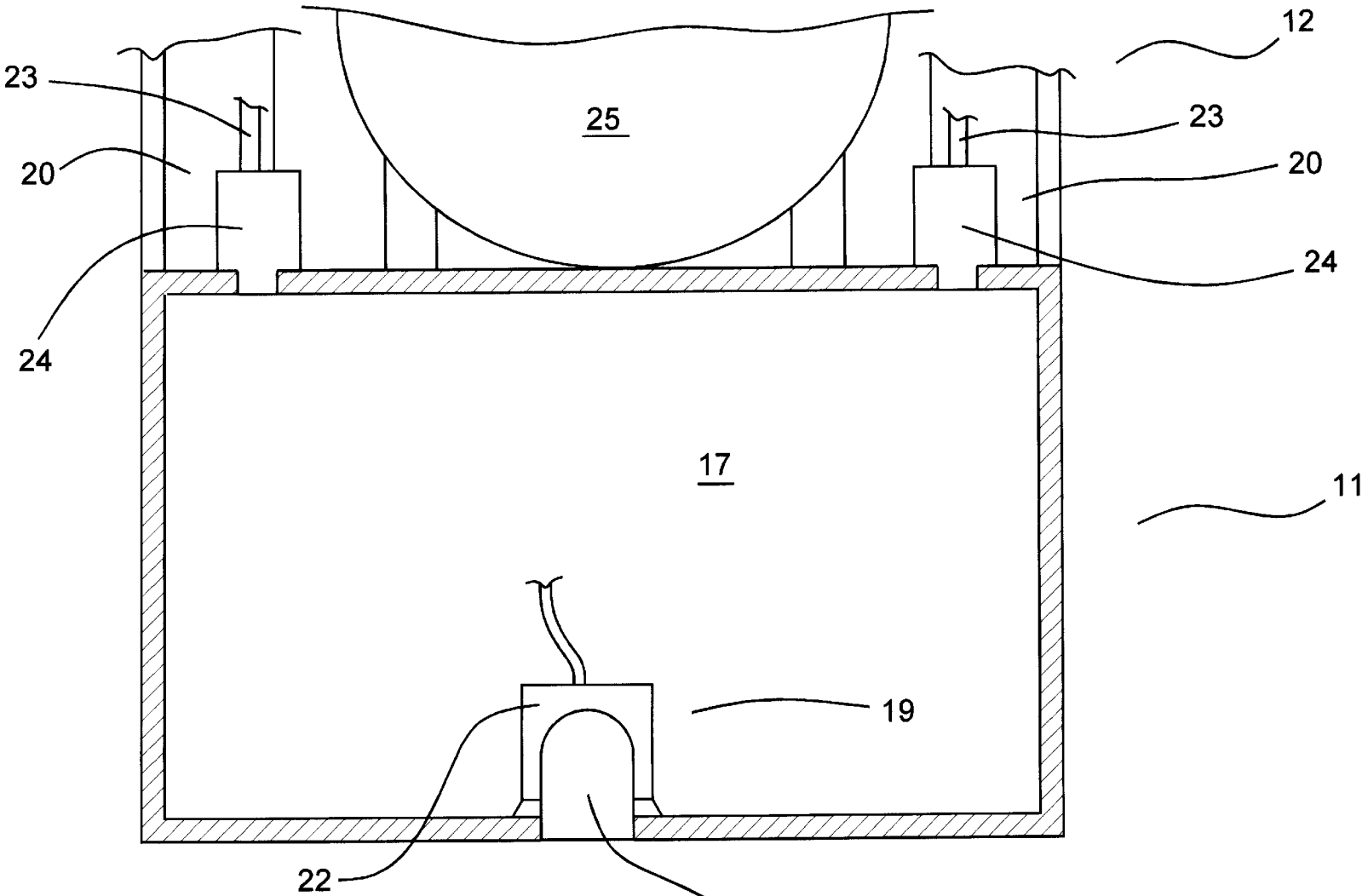
FIG. 4 is a partial, sectioned end elevation view of the pontoon structure of the invention, along line 4—4 of FIG. 1.

The filling and emptying of ballast tank 17 is controlled by sea valve assembly 19 and air valve assemblies 20, schematically illustrated in FIGS. 3 and 4. Sea valve assembly 19 includes pipe 21, connected between an aperture in the hull of the lower section and an aperture in ballast tank 17 to form a passage for the flow of water between the ballast tank and the body of water in which the pontoon is floating, and valve 22 to control the opening and closing of that passageway. Valve 22 is preferably activated remotely, so that the presence of an operator at the location of the valve is not required. Operation of the valve may be activated by an electrically operated solenoid, by an electric motor, by pneumatic fluid, or by hydraulic fluid, for example. Although not preferred, remote mechanical operation may be utilized as the primary means of activation, and mechanical activation apparatus may be provided as a secondary or back-up means. A plurality of sea valve assemblies may be utilized, if desired.

Figure 5:
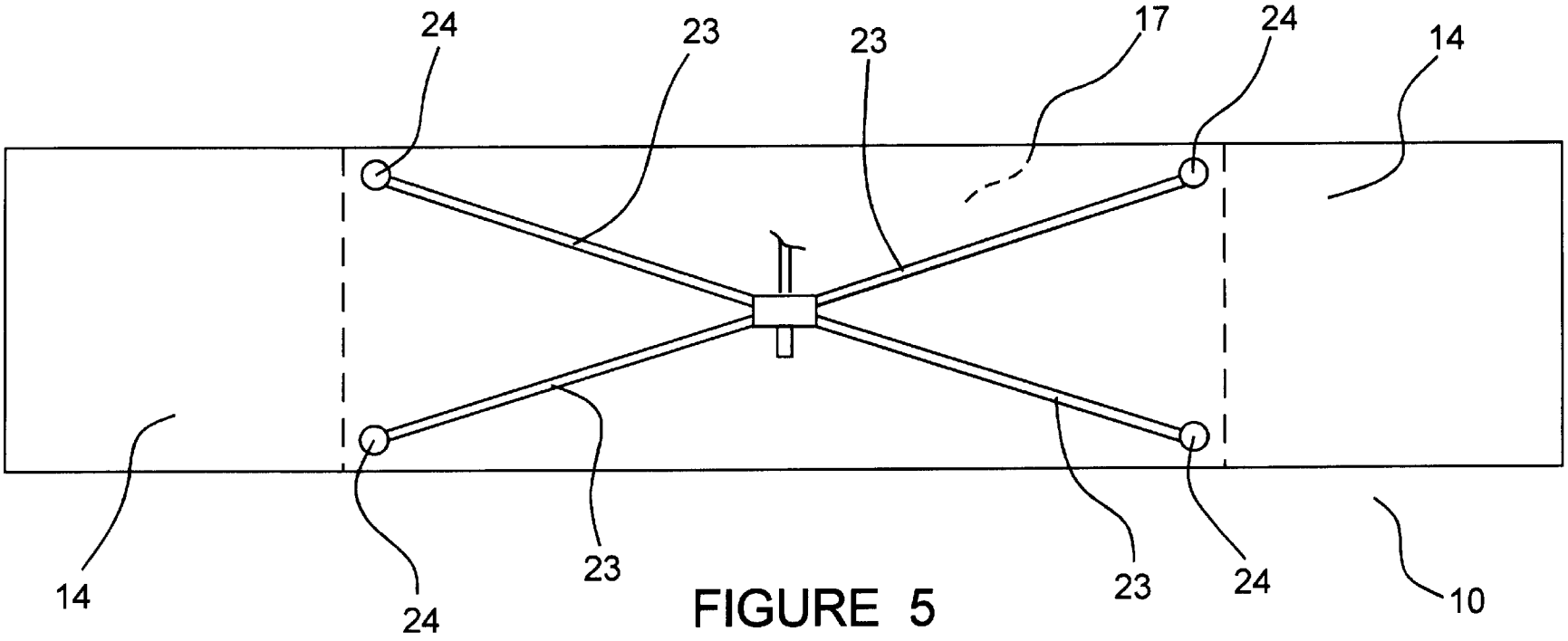
FIG. 5 is a top plan view of the preferred embodiment of the pontoon structure of the invention, with the upper deck, supporting framework, and flotation tanks removed for clarity.

Air valve assemblies 20 are provided to allow air to exit the ballast tank as it is displaced by the entry of water as the ballast tank is filled, and to provide a means for the introduction of pressurized air to force water from the ballast tank when the tank is to be partially or fully emptied. In the preferred embodiment an air valve assembly is provided at each upper corner of the ballast tank, but other arrangements could be utilized if desired. Each air valve assembly includes an air conduit 23, connected to an aperture in ballast tank 17, to provide a passageway for the flow of air to and from the ballast tank, and a check valve 24, to prevent the entry of water into the air conduit. Check valve 24 preferably comprises a float valve that will automatically close and open in response to the presence or absence of water at the valve. In the preferred embodiment of the invention, air conduits 23 from the air valve assemblies extend to a common head 26 disposed at a location that will remain well above the surface of the water in which the pontoon is floating. An illustrative arrangement is shown in FIG. 5. When the sea valve assembly is opened and water flows into the ballast tank, displaced air exits the ballast tank through the air valve assemblies until the sea valve assembly is closed. When the operator desires to empty the ballast tank, a source of pressurized air is connected to the air conduits, preferably at their junction at head 26, and pressurized air is forced into the ballast tank, raising the internal pressure of the tank. The pressurized air may be provided from a compressed air storage tank, from an operating compressor, or a combination. The sea valve is opened and water is forced from the ballast tank through pipe 21 until the ballast tank is empty or the draft of the pontoon has been adjusted to the desired degree. The sea valve is then closed and the flow of air to the tank is terminated. When a plurality of pontoon structures are connected to each other, the activation of the sea valve assembly of each pontoon and the supply of pressurized air to each pontoon is coordinated, so that the adjustment of the draft of each pontoon is coordinated and the connected pontoons can be raised and lowered in the water together.

Figure 6:
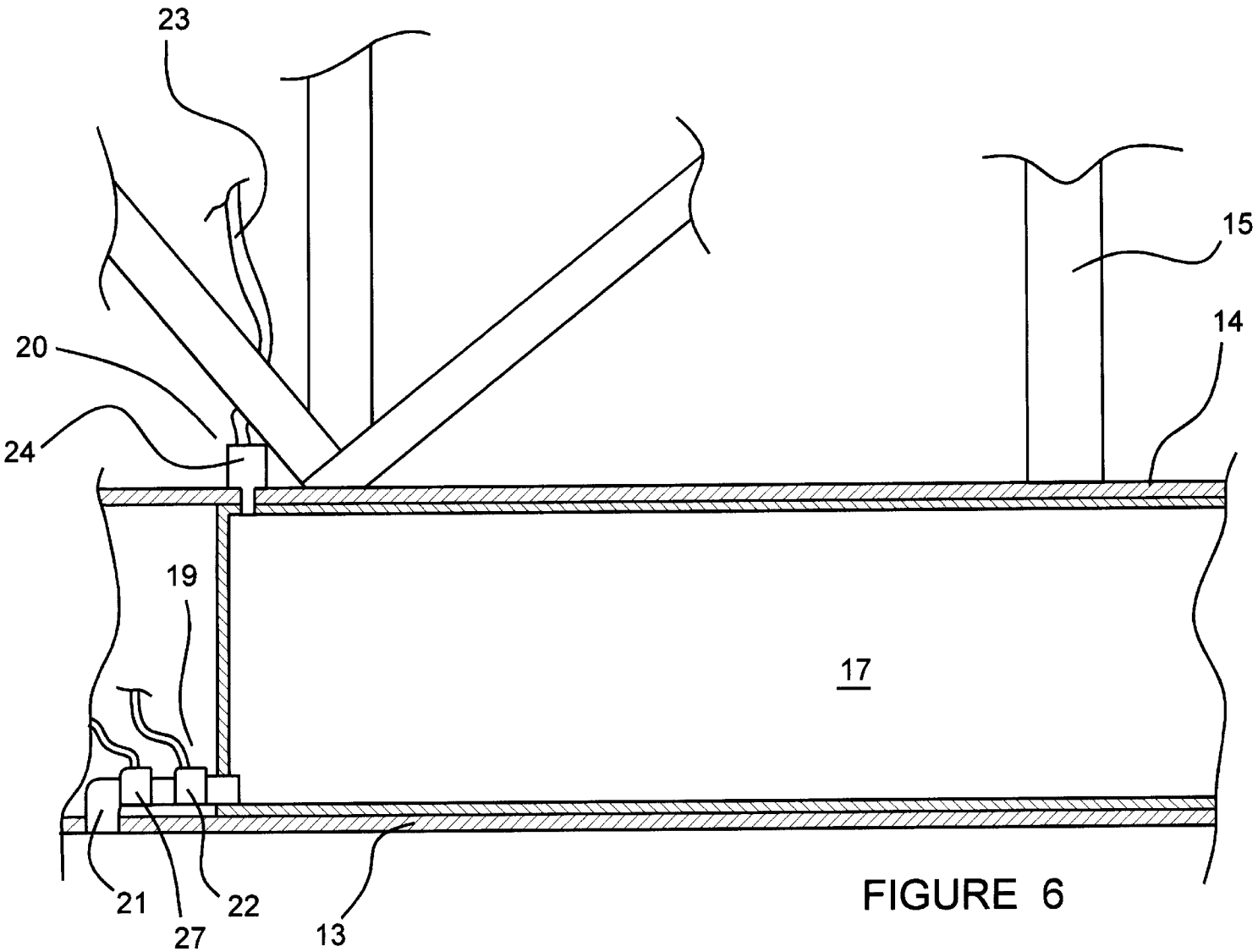
FIG. 6 is a partial, sectioned side elevation view of an alternative embodiment of the pontoon structure of the invention, along line 6—6 of FIG. 2.

In an alternative embodiment of the invention, illustrated in FIG. 6, one or more pumps are provided to empty ballast tank 17 by pumping water from the ballast tank, instead of or even in addition to the use of pressurized air as described above. A pump 27 may be connected in line with pipe 21 and activated to pump water from ballast tank 17 with valve 22 open and with air conduits 23 open to the atmosphere to allow air to flow into the ballast tank through those conduits as water is displaced by pump 27. Other pump placements and piping arrangements could also be used. The pump or pumps may be operated by any appropriate means, such as an electric motor, a pneumatic motor, or a hydraulic motor, for example. It is preferred that operation of the pump or pumps be activated from a remote location, but local activation could be used. If desired, pumping could be utilized in conjunction with the introduction of pressurized air to the ballast tank to accelerate the rate at which the tank is emptied. The pump or pumps could also be used to fill the ballast tank, if desired.

Figure 7:
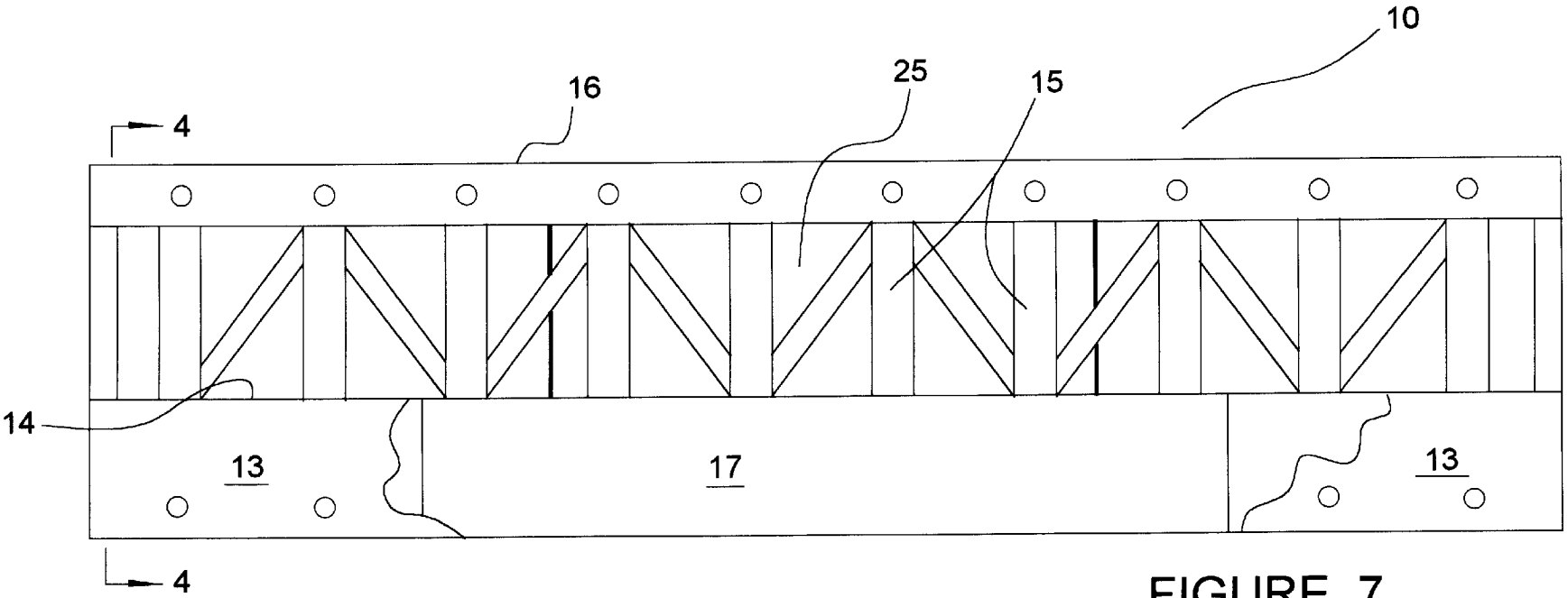
FIG. 7 is a partially cut-away side elevation view of an alternative embodiment of the pontoon structure of the invention with a single flotation tank.

As the ballast tank is filled the pontoon will sink in the water in which it is floating until, as indicated in FIG. 2, the lower section of the pontoon is fully submerged. Because of the increased draft and lower position in the water, the fully ballasted pontoon is more stable in the water and its movement in response to wave action and other water movement is minimized. In the preferred embodiment, a floatation tank 25 is disposed between decks 14 and 16 at each end of the pontoon structure. Each floatation tank 25 is preferably a closed, hollow cylindrical tank filled with air. The floatation tanks assure that the pontoon will be sufficiently buoyant to float with a load placed on deck 16 and with the ballast tank completely filled. With the ballast tank filled the lower section of the pontoon has negative buoyancy and the pontoon is then primarily floating on the floatation tanks, placing the center of buoyancy of the pontoon structure above the center of mass, so that the lower section functions in the nature of a weighted keel to enhance the stability of the pontoon. Although the use of two flotation tanks is preferred, a single flotation tank 25 may be utilized as shown in FIG. 7. If a single flotation tank is used the tank should be centrally disposed for stability. Because the surface of the water in which the pontoon is floating is within the generally open space between the lower deck 14 and the upper deck 16, surface waves are allowed to pass through that space with minimum resistance, and thus exert minimum forces against the pontoon.

Figure 8:
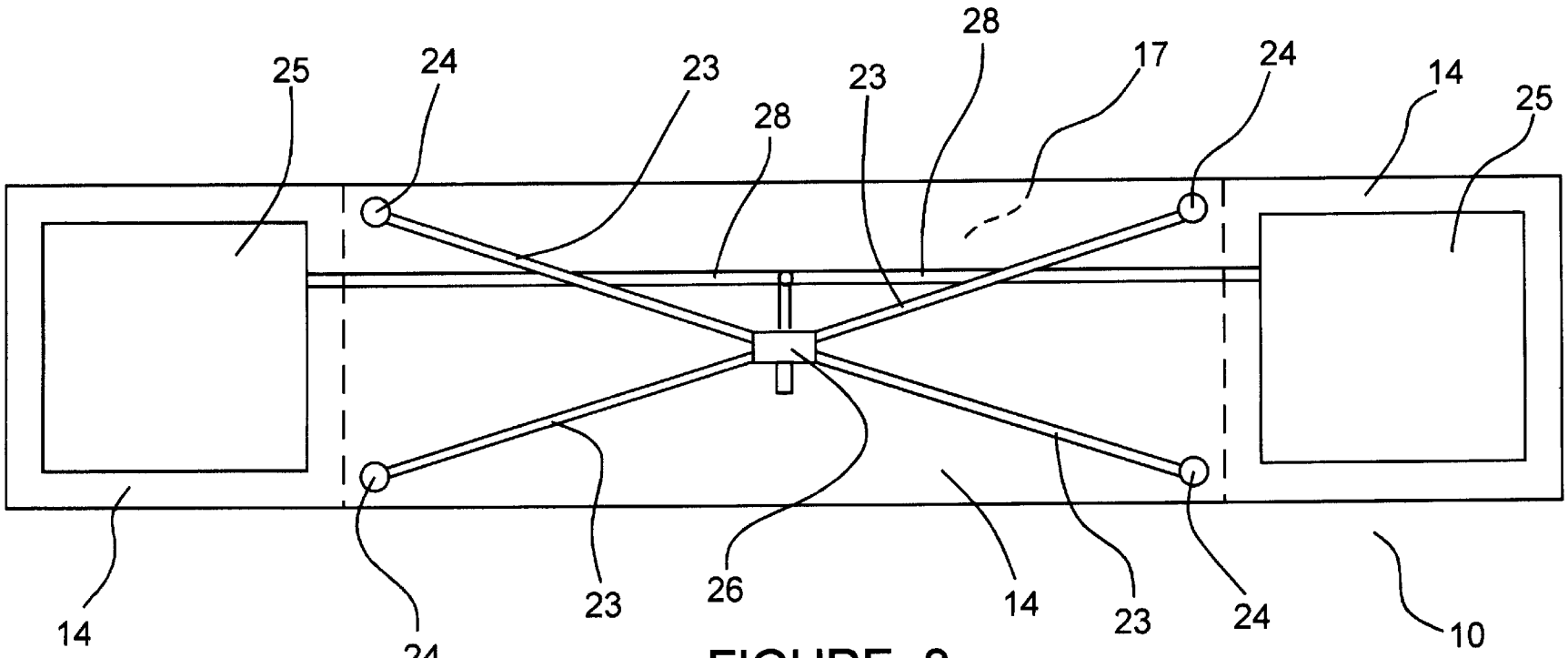
FIG. 8 is a top plan view of an alternative embodiment of the pontoon structure of the invention, with the upper deck, supporting framework, and flotation tanks removed for clarity.

The flotation tanks 25 may be filled with air to a pressure above atmospheric pressure and used as a source of pressurized air to dispel water from the ballast tank 17. As shown in FIG. 8, air may be conveyed from tanks 25 to head 26 through air lines 28.

Figure 9:
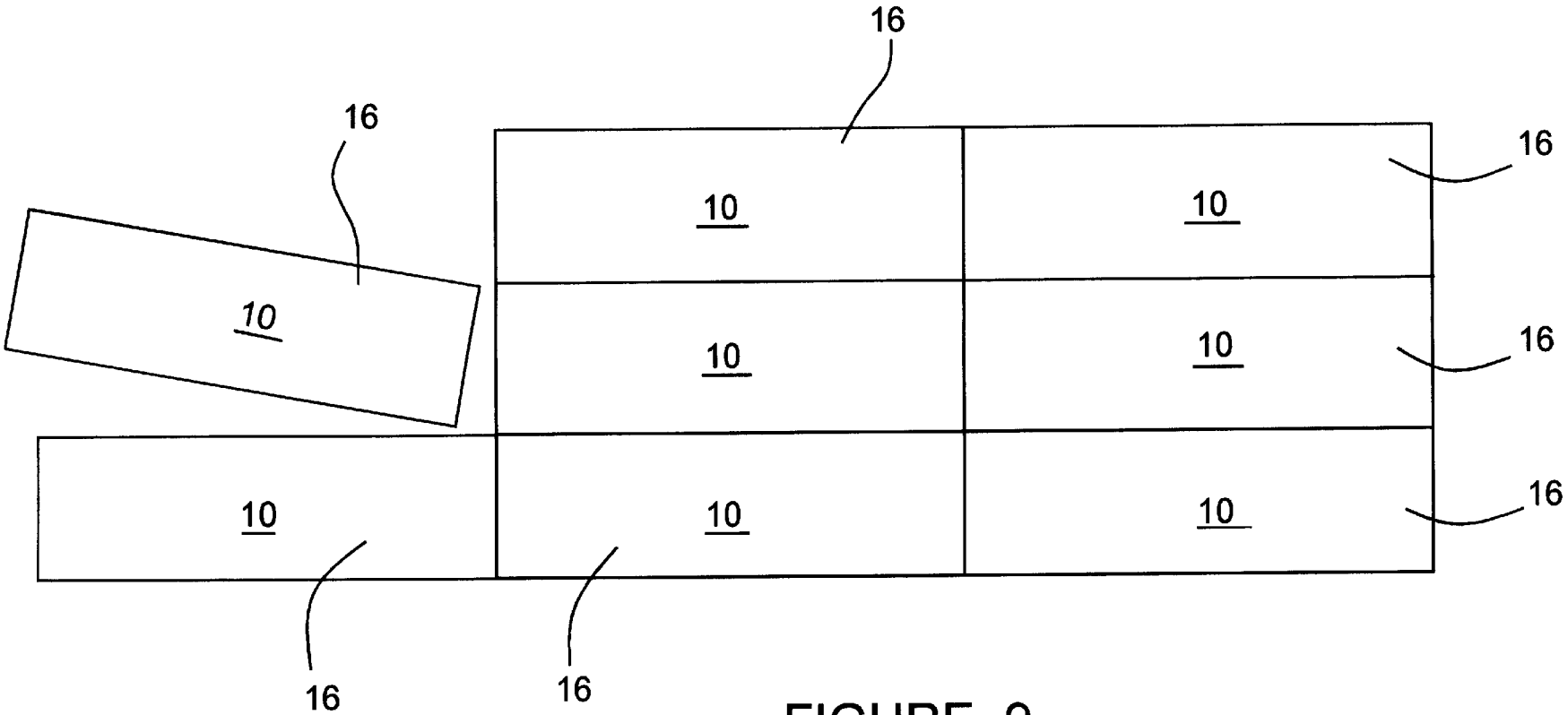
FIG. 9 is a top view of an illustrative arrangement of pontoon structures connected to form a larger structure, with one pontoon structure in process of alignment.

As a non-limiting example of the advantages provided by the pontoon structure of the invention, pontoons to be connected to form a larger structure may be lowered in the water by filling their ballast tanks prior to forming the connections between them. An illustration of one form of such a structure, including a plurality of connected pontoons and a pontoon being aligned for connection, is provided in FIG. 9. With the pontoons floating low in the water they are more stable and exhibit reduced movement in response to water movement, so the operations of aligning and connecting pontoons is facilitated. When all the pontoons forming the final structure have been connected, the ballast tanks may be emptied, raising the connected pontoons in the water and readying the structure for use.

As a further example of the advantages of the pontoon structure of the invention, a structure formed of connected pontoons may be lowered in the water to render the entire structure less susceptible to the effects of rough water associated with storms and other causes. When the water has calmed, the structure may be raised by emptying the ballast tanks of the pontoons, and normal operations resumed.

The ability to adjust the buoyancy of the individual pontoons in a structure comprising multiple connected pontoons can also be used to trim the structure if needed to accommodate uneven deck loading, since the buoyancy of each pontoon in the structure can be independently adjusted.

The foregoing description of the pontoon structure of the invention is illustrative and not for purposes of limitation. The invention is susceptible to various modifications and alternative embodiments in addition to those specifically disclosed, within the overall scope of the invention.

I claim:

1. A pontoon structure adapted to float on the surface of a body of water, comprising a lower section having a hull with a bottom and sidewalls connected to said bottom and extending upwardly therefrom, and a lower deck connected to said sidewalls so as to fully close said hull around a hollow interior thereof;

an upper section having an upper deck disposed above and generally parallel to said lower deck and separated therefrom, and a structural framework interconnected between said lower deck of said lower section and said upper deck such that the space between said lower deck and said upper deck is substantially open;

a hollow ballast tank disposed in said hollow interior of said lower section;

filling means for selectively filling said ballast tank with water drawn from the body of water upon which said pontoon is floating so as to cause said lower section to sink in the body of water upon which said pontoon is floating and increase the draft of said pontoon in said water; and emptying means for selectively emptying water from said ballast tank so as to cause said lower section to rise in the body of water upon which said pontoon is floating and decrease the draft of said pontoon in said water.

2. The pontoon structure of claim 1, further comprising at least one closed flotation tank with a hollow interior disposed between said lower deck and said upper deck.

3. The pontoon structure of claim 1, further comprising a plurality of closed flotation tanks, each with a hollow interior, disposed between said lower deck and said upper deck.

4. The pontoon structure of claim 1 wherein said filling means comprises a first aperture disposed in said hull of said lower section;

a second aperture disposed in said ballast tank;

an open conduit disposed in said interior of said hull and interconnected between said hull and said ballast tank around said apertures so as to create a passageway between the exterior of said hull and the interior of said ballast tank; and valve means disposed in said conduit for the purpose of opening said conduit so as to allow the flow of water through said passageway, and closing said conduit for the purpose of preventing the flow of water through said passageway.

5. The pontoon structure of claim 1, wherein said emptying means comprises an air aperture disposed in said ballast tank;

a source of pressurized air; and an open air conduit interconnected between said source of pressurized air and said ballast tank around said air aperture so as to form a passageway for the flow of air from said source of pressurized air to said ballast tank upon activation of said source of pressurized air.

6. The pontoon structure of claim 1, wherein said hollow ballast tank includes at least one internal baffle.

7. The pontoon structure of claim 5, wherein said emptying means further comprises a check valve interconnected between said ballast tank and said air conduit to prevent the flow of water from said ballast tank into said air conduit.

8. The pontoon structure of claim 4, wherein said emptying means comprises pump means disposed in said conduit for the purpose of pumping water from said ballast tank through said conduit.

9. A floating pontoon structure adapted to be connected to like pontoon structures to form a larger floating structure, said pontoon structure comprising a lower section having a hull with a bottom and sidewalls connected to said bottom and extending upwardly therefrom, and a lower deck connected to said sidewalls so as to fully close said hull around a hollow interior thereof;

an upper section having an upper deck disposed above and generally parallel to said lower deck and separated therefrom, and a structural framework interconnected between said lower deck of said lower section and said upper deck such that the space between said lower deck and said upper deck is substantially open;

a hollow ballast tank disposed in said hollow interior of said lower section;

at least one closed flotation tank with a hollow interior disposed between said lower deck and said upper deck;

filling means for selectively filling said ballast tank with water drawn from the body of water upon which said pontoon is floating so as to cause said lower section to sink in the body of water upon which said pontoon is floating and increase the draft of said pontoon in said water; and emptying means for selectively emptying water from said ballast tank so as to cause said lower section to rise in the body of water upon which said pontoon is floating and decrease the draft of said pontoon in said water.

10. The pontoon structure of claim 9, wherein said ballast tank includes vent means for the purpose of allowing air to exit from said ballast tank as said ballast tank is filled with water.

11. The pontoon structure of claim 9, wherein said filling means comprises a first aperture disposed in said hull of said lower section;

a second aperture disposed in said ballast tank;

an open conduit disposed in said interior of said hull and interconnected between said hull and said ballast tank around said apertures so as to create a passageway between the exterior of said hull and the interior of said ballast tank; and valve means disposed in said conduit for the purpose of opening said conduit so as to allow the flow of water through said passageway, and closing said conduit for the purpose of preventing the flow of water through said passageway.

12. The pontoon structure of claim 9, wherein said emptying means comprises an air aperture disposed in said ballast tank;

a source of pressurized air; and an open air conduit interconnected between said source of pressurized air and said ballast tank around said air aperture so as to form a passageway for the flow of air from said source of pressurized air to said ballast tank upon activation of said source of pressurized air.

13. The pontoon structure of claim 12, wherein said emptying means further comprises an air valve disposed in said air conduit and wherein said source of pressurized air comprises said at least one flotation tank.

14. The pontoon structure of claim 9, wherein said ballast tank has an interior and an exterior and said ballast tank includes vent means for the purpose of equalizing pressure between said interior and said exterior of said ballast tank.

15. The pontoon structure of claim 14, wherein said filling means comprises a first aperture disposed in said hull of said lower section, a second aperture disposed in said ballast tank, an open conduit disposed in said interior of said hull and interconnected between said hull and said ballast tank around said apertures, and valve means disposed in said conduit for the purpose of opening and closing said conduit, and wherein said emptying means comprises a pump disposed in said conduit for the purpose of pumping water from said ballast tank through said conduit.

16. A method of connecting a plurality of pontoon structures to form a larger structure with each of said pontoon structures floating in a body of water, and with each of said pontoon structures including a ballast tank adapted to be selectively filled and emptied with water to adjust the draft of said pontoon by lowering said pontoon in the water when said ballast tank is filled and raising said pontoon in the water when said ballast tank is emptied, comprising the steps of filling said ballast tank of each of said pontoons with water prior to connecting any of said pontoons, thereby lowering said pontoons in said body of water;

connecting said pontoons to form said larger structure with all of said pontoons lowered in said body of water; and emptying said ballast tank of each of said pontoons so as to simultaneously raise said connected pontoons in said body of water.

* * * * *